US011255516B1

(12) United States Patent
Nolan et al.

(10) Patent No.: US 11,255,516 B1
(45) Date of Patent: Feb. 22, 2022

(54) LIGHTING SYSTEM WITH BALLISTIC IMPACT RESISTANCE

(71) Applicant: M3 Innovation, LLC, Syracuse, NY (US)

(72) Inventors: Christopher D. Nolan, Camillus, NY (US); Joseph R. Casper, Baldwinsville, NY (US)

(73) Assignee: M3 Innovation, LLC, Syracuse, NY (US)

( * ) Notice: Subject to any disclaimer, the term of this patent is extended or adjusted under 35 U.S.C. 154(b) by 0 days.

(21) Appl. No.: 17/101,620

(22) Filed: Nov. 23, 2020

(51) Int. Cl.

| | |
|---|---|
| ***F21V 15/04*** | (2006.01) |
| ***F21V 17/06*** | (2006.01) |
| ***F41H 5/06*** | (2006.01) |
| ***F21Y 105/16*** | (2016.01) |
| ***F21Y 115/10*** | (2016.01) |

(52) U.S. Cl.
CPC ..... *F21V 15/04* (2013.01); *F21V 17/06* (2013.01); *F21Y 2105/16* (2016.08); *F21Y 2115/10* (2016.08); *F41H 5/06* (2013.01)

(58) Field of Classification Search
CPC ..... F21V 15/04; F21V 17/06; F21V 5/008; F21V 15/005; F21V 25/00; F21V 25/12; F21V 31/005; F21Y 2115/10; F21Y 2105/16; F21W 2131/103; F41H 5/06
See application file for complete search history.

(56) References Cited

U.S. PATENT DOCUMENTS

| | | | | |
|---|---|---|---|---|
| 4,489,367 | A * | 12/1984 | Herron | F21V 25/12 362/267 |
| 5,823,665 | A * | 10/1998 | Braun | F21S 8/086 362/376 |
| 6,164,800 | A * | 12/2000 | McIlwraith | F21V 11/06 362/342 |
| 8,162,509 | B2 * | 4/2012 | Mackin | F21V 19/04 362/267 |
| 8,256,940 | B2 * | 9/2012 | Brown | F21S 41/645 362/509 |
| 8,721,110 | B2 * | 5/2014 | Luo | F21L 4/027 362/186 |
| 10,234,129 | B2 * | 3/2019 | Oostdyk | F21V 29/15 |
| 2012/0087118 | A1 * | 4/2012 | Bailey | F21V 5/04 362/235 |
| 2017/0146225 | A1 * | 5/2017 | Chien | F21V 29/77 |
| 2021/0123583 | A1 * | 4/2021 | Gastineau | F21V 5/007 |

* cited by examiner

*Primary Examiner* — Peggy A Neils
(74) *Attorney, Agent, or Firm* — Bond Schoeneck and King PLLC; David Nocilly

(57) ABSTRACT

A luminaire that can resist the shock associated with a ballistics event and continue to operate. The luminaire has a base formed from high ductility aluminum. An illumination source, such as a light emitting diode array, is secured to a support of the base. A lens having a gasket is positioned over the illumination source and secured thereto with a clamp. A ballistic shield having a dual gasket is coupled to the clamp by a bezel positioned over the ballistic shield and secured to the clamp. The gaskets extending around the peripheral edges of the lens and the shield cooperate with the highly ductile aluminum base to reduce the transmission of any shock associated with a ballistic event to the illumination source and associated electronics.

15 Claims, 6 Drawing Sheets

LIGHTING SYSTEM WITH BALLISTIC IMPACT RESISTANCE

BACKGROUND OF THE INVENTION

1. Field of the Invention

The present invention relates to lighting systems and, more specifically, to a luminaire with improved ballistic resistance.

2. Description of the Related Art

Lighting systems, such as sports field luminaires, street lights, traffic lights, and parking lot lights, are frequency subjected to both unintentional and intentional damage caused by projectiles. For example, it is not uncommon for lighting systems to be the target of vandals that can fire projectiles ranging from sticks and stones to BB rounds and high velocity ammunition in an attempt to damage the system. While it is possible to manufacture the housing of a lighting system from bullet proof materials, the energy imparted by a projectile will nevertheless damage the internal electronics and cause a failure of the lighting system. Accordingly, there is a need in the art for a lighting system that is designed to protect the internal electronic system from failure in response to a ballistic event.

BRIEF SUMMARY OF THE INVENTION

The present invention is a luminaire that can resist the shock associated with a ballistics event and continue to operate. The luminaire has a base formed from high ductility aluminum and an illumination assembly attached to the base that can absorb and distribute the shock associated with a ballistic event. The illumination assembly includes an illumination source, such as a light emitting diode array, that is secured to a support of the base. A lens having a peripheral edge positioned over the illumination source and secured thereto with an adaptor. The lens may be formed from moldable silicone. A ballistic shield having a peripheral edge with silicone foam gasket extending outwardly from both sides its peripheral edge is seating in the adaptor and clamped in place with a bezel positioned over the ballistic shield and secured to the base. The peripheral edge of the lens includes ribs between the base and the adaptor and is formed from silicon to cooperate with the highly ductile aluminum base to reduce the transmission of any shock associated with a ballistic event to the illumination source and associated electronics. The illumination source may be an array of light emitting diodes secured to the base. The adaptor may include a shoulder defining a recess that captures the ballistic shield. The ballistic shield is spaced apart from the lens to define a cavity therebetween. The adaptor and the bezel may be formed from a high ductility aluminum alloy.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
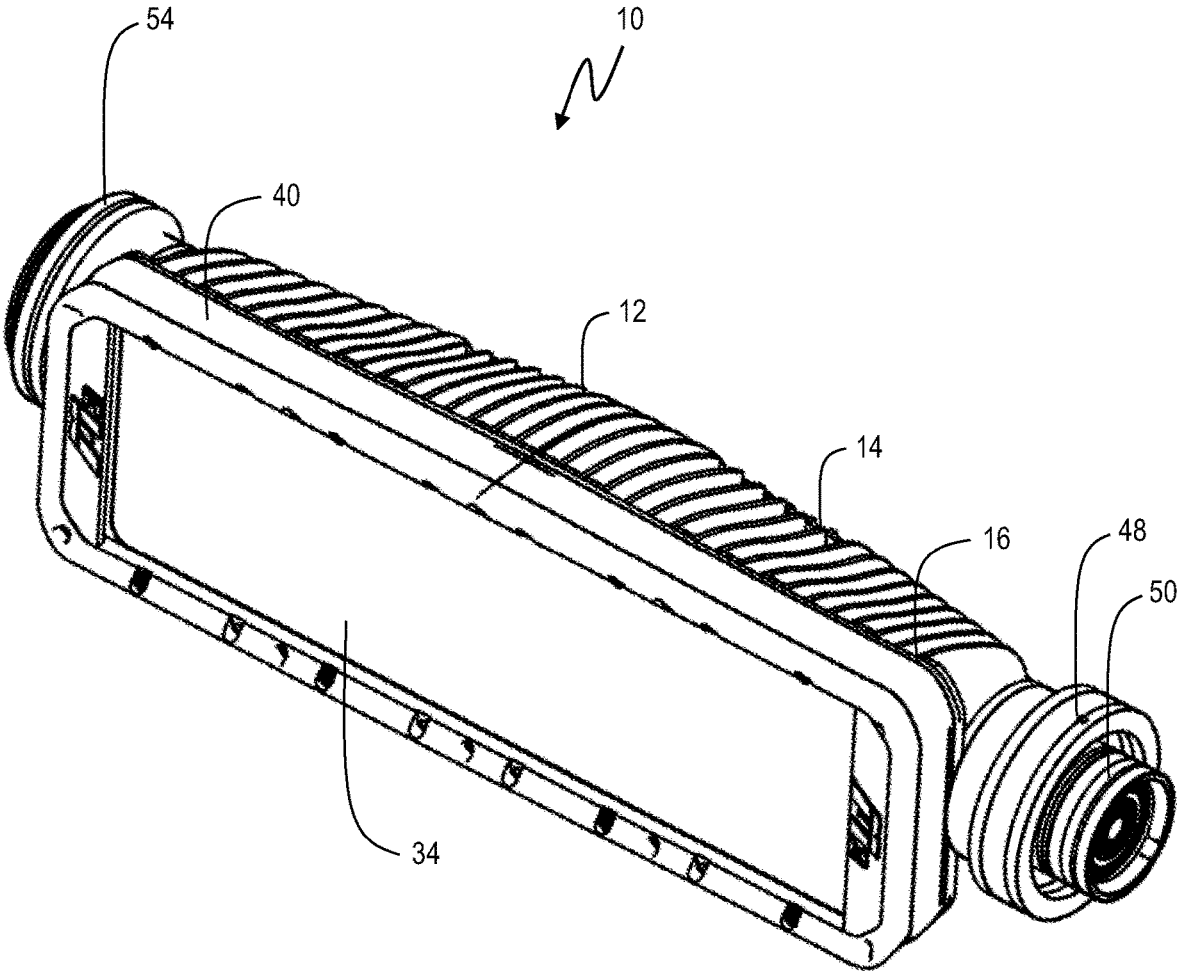
FIG. 1 is a perspective view of a luminaire according to the present invention.

Referring to the figures, wherein like numeral refer to like parts throughout, there is seen in FIG. 1 a lighting system luminaire 10 that is resistance to ballistic event and will remain operational despite the shock results from a ballistic event. More specifically, luminaire 10 comprises a base 12 and an illumination assembly 14 coupled to base 12. Ballistic resistant illumination assembly 14 provides protection against a wide variety of ballistic events that can cause various shock loads. For example, a ballistic event involving a low mass-high velocity projectile, such as a bullet, will typically input a high frequency, short duration shock pulse in the order of milliseconds or fractions of milliseconds. If the projectile impacts ballistic glass the shock pulse shape and duration will be different than if it impacts a softer, more embeddable material such as the aluminum heat sink. In either case, the resulting pulse into luminaire 10 is relatively short and causes a wide spectrum of frequencies and acceleration amplitudes to travel into the interior of luminaire 10 that must be absorbed to avoid operational failures. Projectiles having a larger mass but lower relative velocity, such as stones, hail, hockey pucks, etc. have lower energy and impact somewhat lower pulse frequencies that bullets and the like. Finally, softer projectiles having a larger with low velocity, such as a softball or basketball, produce a different shock profile.

Figure 2:
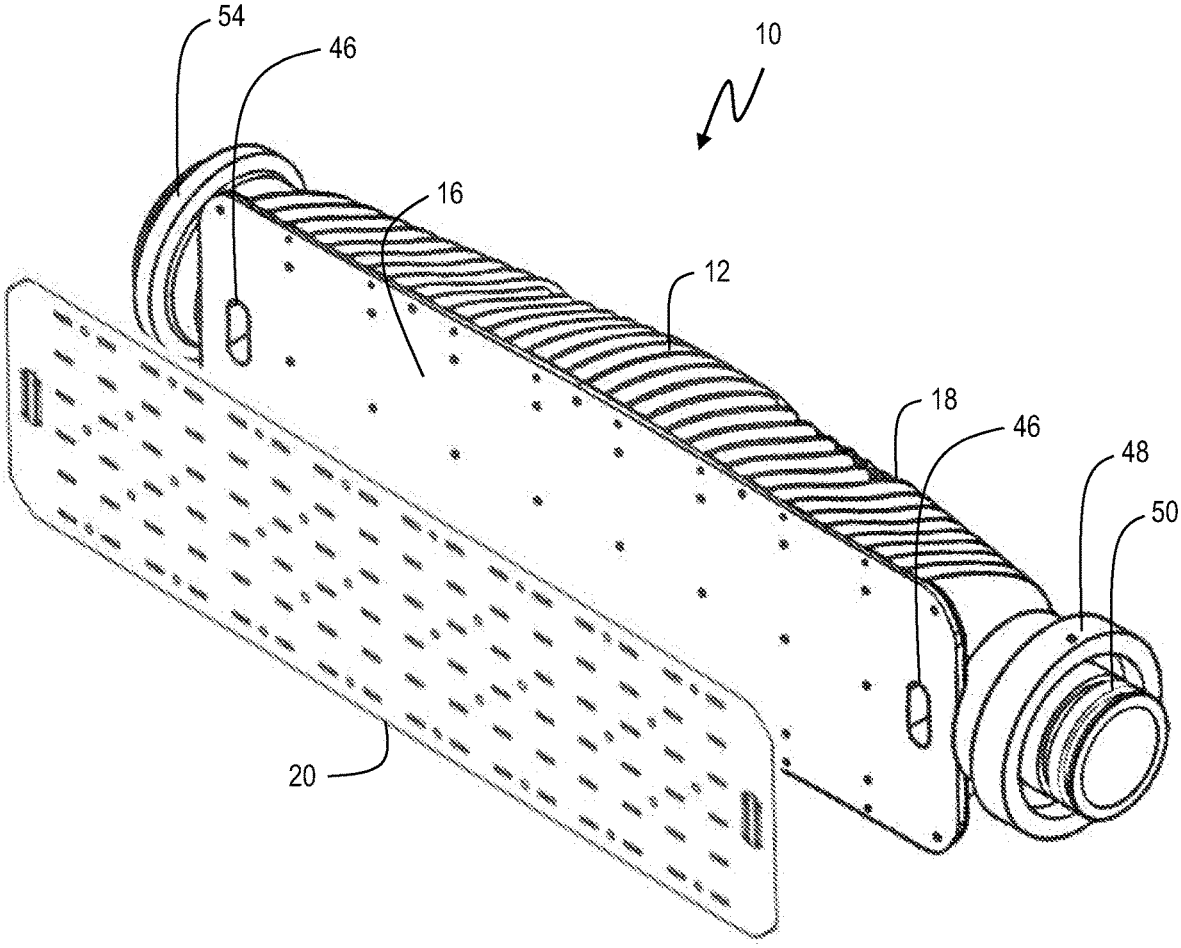
FIG. 2 is an exploded view of a base and an illumination array for a luminaire according to the present invention.

Referring to FIG. 2, base 12 defines a support 16 on which a ballistic illumination assembly 14 and associated electronics may be mounted and acts as a heat sink for the illumination source of ballistic illumination assembly 14. A series of fins 18 extend from base 12 to assist with thermal dissipation of any heat generated by ballistic illumination assembly 14. Base 12 may be manufactured by high pressure casting a high ductility aluminum alloy, such as Mercalloy™ HD (high ductility, AA 368) available from Mercury Marine. The use of a high ductility aluminum alloy allows base 12 to have yield strengths of about 20 ksi (Mpa) and an elongation ability of up to about ten percent. Fins 18 may be integrally formed as part of base during the casting process for improved strength and thermal conductivity.

As seen in FIG. 2, ballistic illumination assembly 14 includes a light emitting array 20, such as an array of light emitting diodes (LEDs) and accompanying circuitry mounted to a substrate and then attached to support 16. Standard LED circuitry, such as LED drivers, EMI filters, active power factor correction, DC power conditioning circuitry, AC/DC power conversion, etc. may be includes as part of illumination assembly 14, any one or more of the components of the LED circuitry may be positioned remotely from luminaire 10 and interconnected thereto by a wiring harness with the remaining circuitry, such as just the LED circuit board and electronic connectors attached to support 16. Light emitting array 20 is preferably formed from chip scale packages that have a lower mass than other LED implementations and have a smaller mass such that the ratio of solder to surface area is higher than with larger mass and size LED implementations. Chip scale package LEDs are implemented as flip chips with a bare LED die (chip) on which a phosphor layer is coated, with the underside of the die metallized with the P and N contacts to form the electrical connection and thermal path. Chip scale packaging thus eliminates the plastic submount or ceramic substrate used by other approaches. A lower mass and higher solder to surface area reduced the effects of any shock experienced by light emitting array 20.

Figure 6:
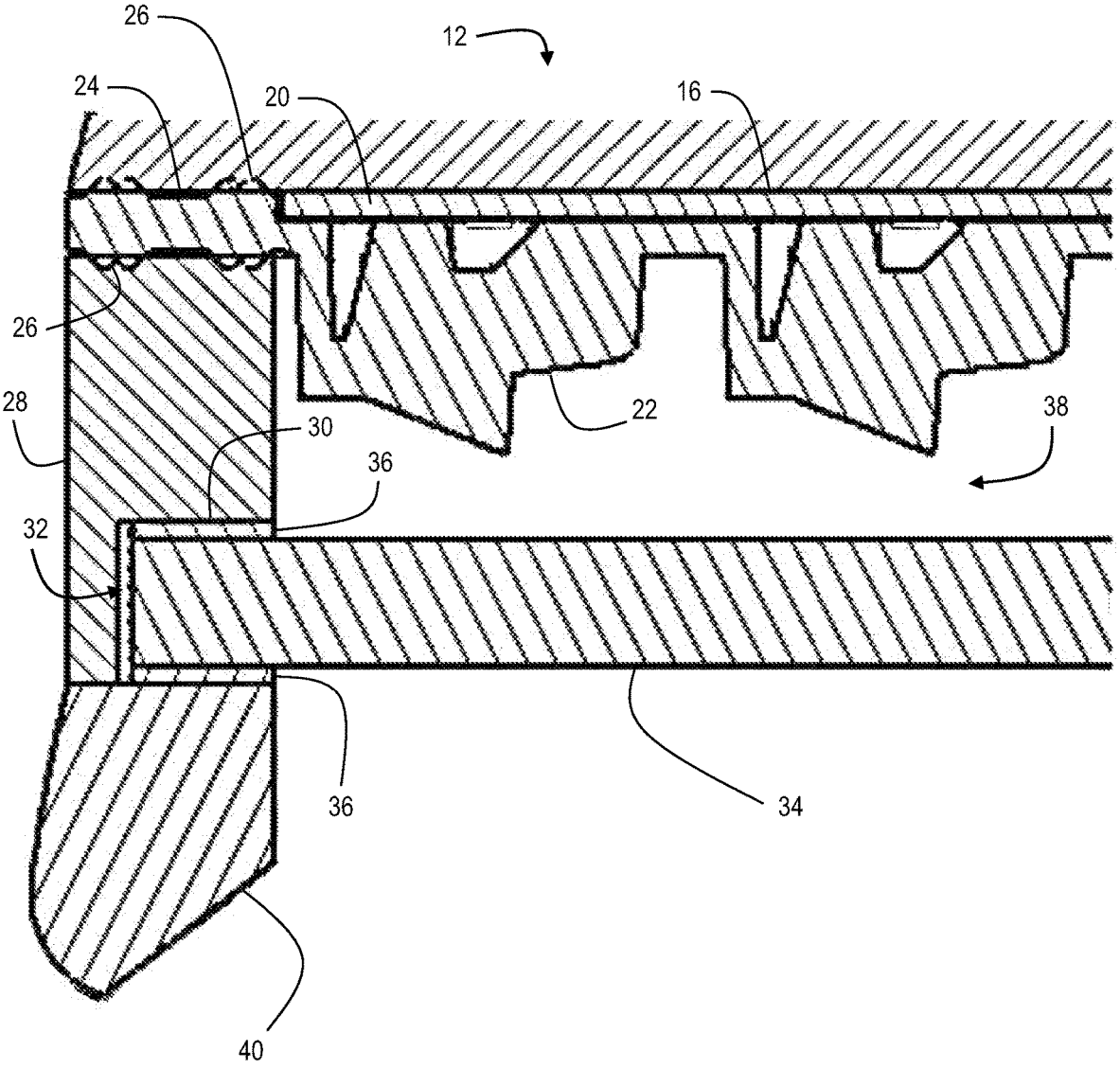
FIG. 6 is a detailed view of area B of FIG. 5.

Referring to FIGS. 3 through 6, ballistic illumination assembly 14 further comprises a lens 22 positioned over light emitting array 20 and having a peripheral edge 24 that extends beyond light emitting array 20. Lens 22 is preferably manufactured from an optically clear or transparent silicone, such as SILASTIC™ MS-1002 Moldable Silicone available from Dow Corning, that is a medium viscosity, high Shore A hardness (about 74), two-part, 1 to 1 ratio, fast curing optical molding resin for producing fine detail with good resistance to environmental aging. Lens 22 is shaped to condition the light emitted from illumination source, e.g., to focus or to disperse some or all of the light emitted from light emitting array 20, as desired for a particular application of luminaire 10. Peripheral edge 24 of lens 22 includes sealing ribs 26 positioned on both sides thereof for sealingly engaging support 16 around the perimeter of light emitting array 20 and an adapter ring 28 positioned thereover. For example, as seen in FIG. 6, sealing ribs 26 may comprise adjacent pairs of sealing ridges formed into both sides of peripheral edge 24. Lens 22 thus conditions the illumination and protects light emitting array 20 from the environment.

Figure 3:
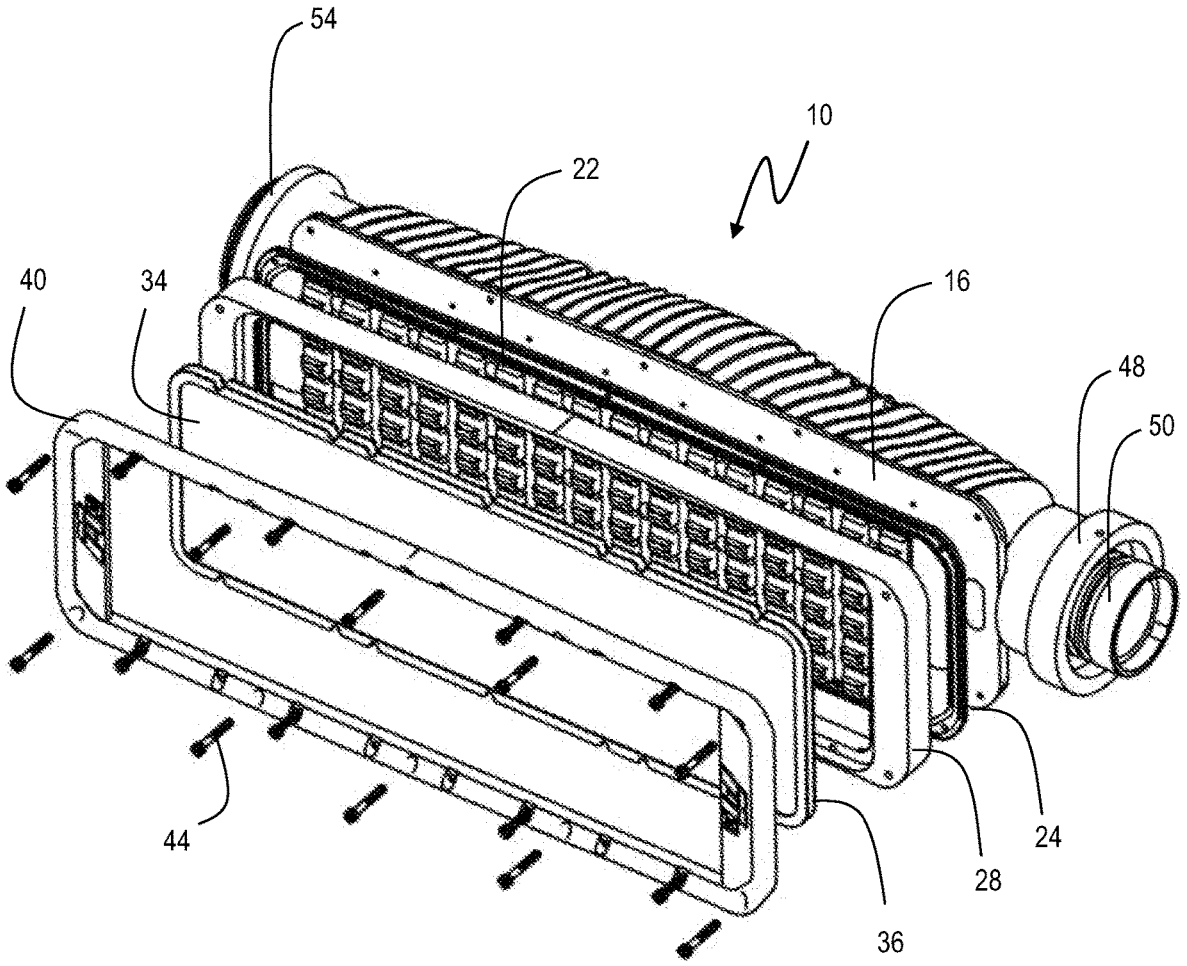
FIG. 3 is an exploded view of a luminaire according to the present invention.

Adapter ring 28 is secured over peripheral edge 24 of lens 22 so that ring 28 engages and seals against the opposing side of peripheral edge 24 of lens 22. Adapter ring 28 includes a shoulder 30 formed therein to define a recess 32 facing inwardly toward the center of luminaire 10. A ballistic shield 34 is positioned in recess 32 in spaced relation to lens 22 to define a cavity 38 therebetween. Ballistic shield 34 includes resilient gaskets 36 that are positioned around both the inward and outward facing sides of the peripheral edge of ballistic shield 34. Resilient gaskets 36 may comprise a compact silicone foam, such as an HT-800 silicone foam having a density of 22 PCF and a CFD range of 6-14 PST that is resistant to UV, ozone, and extreme temperatures. Gasket 36 on the inwardly facing side of ballistic shield 34 seals and cushions ballistic shield 34 within recess 32 of adapter ring 28. Ballistic shield 34 may comprise ballistic glass, such as a layered composite of laminated glass that is rated for bullet resistance. The particular composition and thickness of the ballistic glass used to form shield 34 may be selected according to the expected threat level, as the amount of protection offered by various off-the-shelf ballistic glass materials are well established and governed by industry standards. Ballistic shield 34 is secured in position by clamping bezel 40 positioned over the periphery of ballistic shield 34 and in sealing contact with the outwardly facing resilient gasket 36 of ballistic shield 34. It should be recognized that any failure of ballistic shield 34 in response to a significant enough ballistic event that breaches ballistic shield 34 will still not adversely impact the operation of luminaire 10 as lens 22 will continue to enclose and protect light emitting array 20 subsequent to the ballistic event. As seen in FIG. 3, any or all of the components of ballistic illumination assembly 14 may be secured in appropriate place using one or more repositionable fasteners 44, such as bolts, that extend inwardly to securely engage with base 12.

Figure 4:
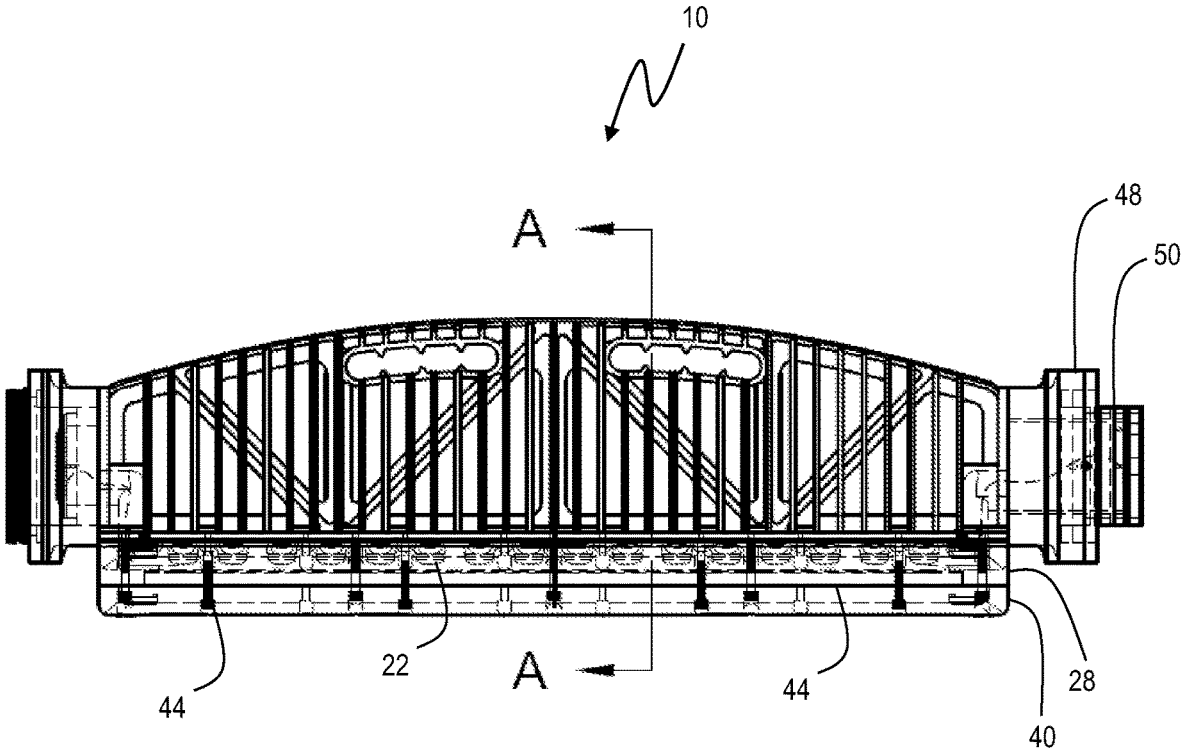
FIG. 4 is a top plan of a luminaire according to the present invention.
Figure 5:
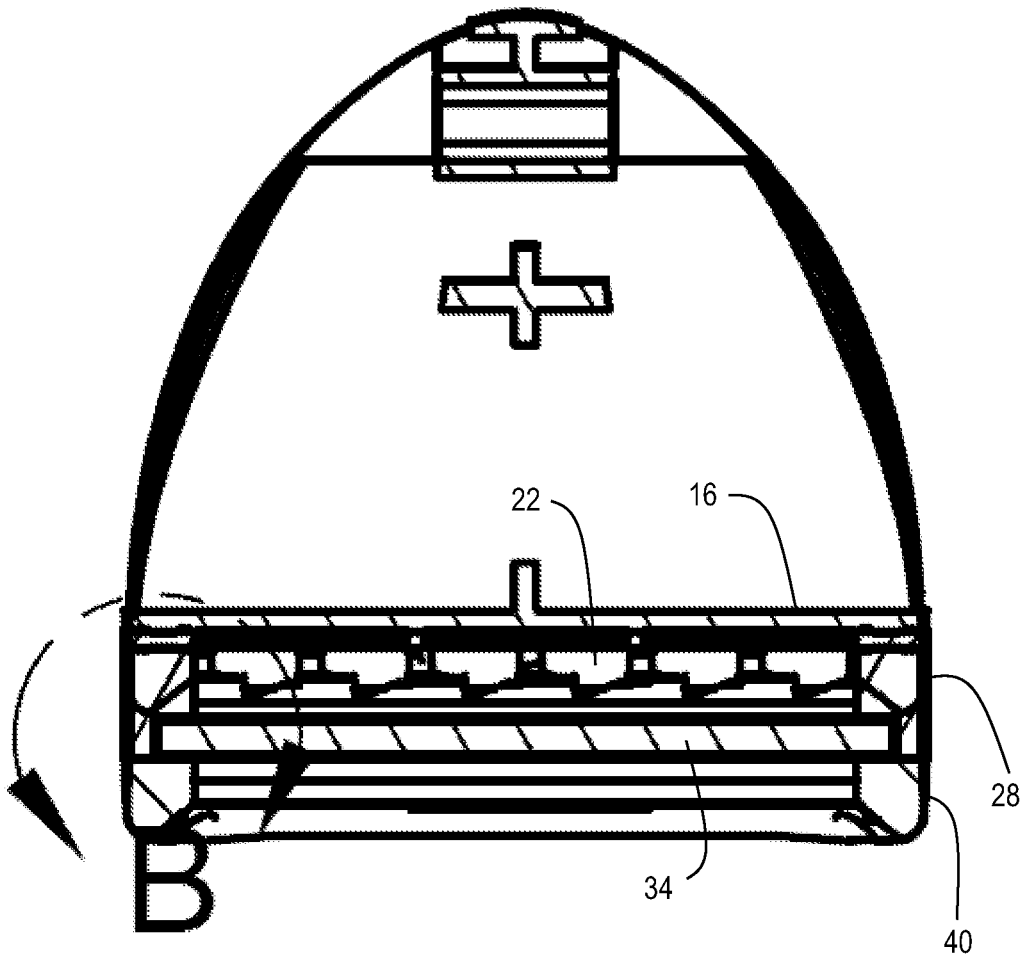
FIG. 5 is a cross-sectional view of a luminaire according to the present invention taken along line A-A of FIG. 4.

As seen in FIG. 4, base 12 include wiring pathways 46 that allows the electrical components to light emitting array 20 to be interconnected to an external coupler 48 internally of base 12. Coupler 48 is adapted to be interconnected to a correspondingly adapted mating coupler that includes contacts interconnected to a power source and is mounted to the location where luminaire 10 is to be located, thereby allowing light emitting array 20 to receive power for illumination. For example, coupler 50 is shown with a set of exemplary external, circumferentially extending rings 52 that can conduct electricity and interconnect with a corresponding set of contacts positioning internally of a mating coupler 54, which can be on another luminaire 10 or a mounting unit attached to a support pole. As wiring pathways 46 allow for connection of light emitting array 20 to power, luminaire 10 lacks any exposed or external wiring that could be compromised by a ballistic event.

What is claimed is:

1. A luminaire, comprising a planar base;

an illumination source comprising a light emitting diode array positioned on a planar substrate and mounted to the planar base;

a lens shaped to condition the light emitted from the illumination source positioned in covering relation to the illumination source and having a peripheral edge extending beyond the illumination source;

an adaptor positioned over the peripheral edge of the lens and secured to the planar base;

a ballistic shield seated in the adaptor in spaced relation to the lens; and a bezel positioned over at least a portion of the ballistic shield and secured against the adaptor.

2. The luminaire of claim 1, wherein the base is formed from a high ductility aluminum alloy.

3. The luminaire of claim 2, wherein the high ductility aluminum alloy has a yield strength of about 20 ksi (Mpa) and an elongation ability of up to about ten percent.

4. The luminaire of claim 3, wherein the ballistic shield comprises ballistic glass.

5. The luminaire of claim 4, wherein the lens is formed from silicone.

6. The luminaire of claim 5, wherein the peripheral edge of the lens includes at least one sealing rib formed therein.

7. The luminaire of claim 5, wherein the ballistic shield includes a first gasket extending between the ballistic shield and the adaptor.

8. The luminaire of claim 7, wherein the ballistic shield includes a second gasket extending between the ballistic shield and the bezel.

9. The luminaire of claim 8, wherein the first gasket and the second gasket are formed from a silicone foam.

10. The luminaire of claim 2, wherein the illumination source is an array of light emitting diodes.

11. The luminaire of claim 10, wherein the base defines a support to which the array of light emitting diodes is secured.

12. The luminaire of claim 11, wherein the base includes a pathway extending therethrough that permits electrical connection between the array of light emitting diodes and an electrical coupler associated with the base.

13. The luminaire of claim 1, wherein the adaptor includes a shoulder defining a recess that captures the ballistic shield.

14. The luminaire of claim 13, wherein the ballistic shield is spaced apart from the lens to define a cavity therebetween.

15. The luminaire of claim 14, wherein the adaptor and the bezel is formed from a high ductility aluminum alloy.

* * * * *